US007534012B2

(12) United States Patent
Hirose

(10) Patent No.: US 7,534,012 B2
(45) Date of Patent: May 19, 2009

(54) ILLUMINATION DEVICE, LIGHT IRRADIATION APPARATUS USING THE SAME, AND METHOD FOR PRODUCING PHOTOREACTION PRODUCT SHEET WITH THE APPARATUS

(75) Inventor: Isao Hirose, Ibaraki-shi (JP)

(73) Assignee: Nitto Denko Corporation, Osaka (JP)

( * ) Notice: Subject to any disclaimer, the term of this patent is extended or adjusted under 35 U.S.C. 154(b) by 363 days.

(21) Appl. No.: 10/588,307

(22) PCT Filed: Jan. 27, 2005

(86) PCT No.: PCT/JP2005/001551

§ 371 (c)(1),
(2), (4) Date: Aug. 3, 2006

(87) PCT Pub. No.: WO2005/080860

PCT Pub. Date: Sep. 1, 2005

(65) Prior Publication Data

US 2008/0273337 A1 Nov. 6, 2008

(30) Foreign Application Priority Data

Feb. 4, 2004 (JP) ..... 2004-027542

(51) Int. Cl.
*F21V 7/06* (2006.01)
*F21V 7/08* (2006.01)

(52) U.S. Cl. ..... 362/296; 362/346

(58) Field of Classification Search ..... 362/341, 362/346, 296, 347, 350
See application file for complete search history.

(56) References Cited

U.S. PATENT DOCUMENTS 3,763,348 A 10/1973 Costello
4,517,630 A * 5/1985 Dieffenbach et al. ..... 362/509
5,989,283 A * 11/1999 Wilkens ..... 607/88

(Continued)

FOREIGN PATENT DOCUMENTS

JP 61-70311 U 5/1986

(Continued)

OTHER PUBLICATIONS

International Search Report of PCT/JP2005/001551, date of mailing Apr. 19, 2005.

(Continued)

*Primary Examiner*—Stephen F. Husar
*Assistant Examiner*—Peggy A. Neils
(74) *Attorney, Agent, or Firm*—Westerman, Hattori, Daniels & Adrian, LLP.

(57) ABSTRACT

The present invention provides an illumination device including a cylindrical light source and a curved mirror for reflecting light radiated from the cylindrical light source, wherein the curved mirror has a light reflection surface which has a shape of a portion of an elliptic curve having a first focal point and a second focal point on a reference axis of the curved surface, in a cross-sectional surface perpendicular to the axial direction of the light source, and the cylindrical light source is disposed on the reference axis at a position between the first focal point and the second focal point, a light irradiation apparatus including the illumination device, and a method for producing a photoreaction product sheet using the irradiation apparatus.

8 Claims, 7 Drawing Sheets

U.S. PATENT DOCUMENTS

| | | | | |
|---|---|---|---|---|
| 6,123,436 | A * | 9/2000 | Hough et al. | 362/296 |
| 6,520,668 | B1 * | 2/2003 | Reiss | 362/516 |
| 6,899,451 | B2 * | 5/2005 | Kittelmann et al. | 362/538 |
| 6,943,930 | B2 * | 9/2005 | Mi et al. | 359/247 |
| 2002/0141182 | A1 | 10/2002 | Holten | |

FOREIGN PATENT DOCUMENTS

| | | | |
|---|---|---|---|
| JP | 4-29739 | A | 1/1992 |
| JP | 4-270608 | A | 9/1992 |
| JP | 7-275775 | A | 10/1995 |
| JP | 2000-86984 | A | 3/2000 |
| WO | WO 02/14925 | A2 | 2/2002 |

OTHER PUBLICATIONS

Chinese Office Action Issued on Sep. 5, 2008 for corresponding Chinese Patent Application No. 2005800032891.

* cited by examiner

ILLUMINATION DEVICE, LIGHT IRRADIATION APPARATUS USING THE SAME, AND METHOD FOR PRODUCING PHOTOREACTION PRODUCT SHEET WITH THE APPARATUS

FIELD OF THE INVENTION

The present invention relates to an illumination device for effectively radiating light so as to attain uniform illuminance distribution over a wide range. In particular, the present invention relates to an illumination device for use in photo-polymerization for forming an adhesive layer during a manufacturing process of an adhesive tape, and light irradiation apparatus using the same.

BACKGROUND ART

As a method for manufacturing a photoreaction product sheet, such as an adhesive tape, the following method is known. That is, a substrate of, e.g., a filmshape, is coated to form a photoreactive composition layer of an appropriate thickness, and the thus-applied photoreactive composition layer is caused to react by means of light irradiation with a light irradiation apparatus, thereby forming a photoreaction product layer. In many cases, light irradiation apparatus of this type employs cylindrical light sources as light sources, which are, in many cases, arranged vertically with respect to a feed direction of a photoreaction product sheet, which is subjected to irradiation (hereinafter such a product sheet is referred to as a "subject") (see, e.g., Reference 1).

However, the cylindrical light source radiates light by means of discharging of electrodes on two sides thereof. Accordingly, illuminance of light is likely to be uniform at the center of the cylinder. However, it is likely to be distributed more sparsely towards the electrodes on the respective ends. To this end, a technique of arranging the cylindrical light sources parallel with respect to a feed direction of a photoreaction product sheet, which is subjected to irradiation, has been disclosed (see, e.g., Reference 2).

[Reference 1] JP 2000-86984 A

[Reference 2] JP 07-275775 A

However, the illumination device employed in Reference 1 and Reference 2 is a general illumination device which has been used conventionally. FIG. 6 shows a schematic view of an example of such an illumination device. As shown in FIG. 6, a illumination device of a conventional, general light-gathering type comprises: a light source 22; and a curved mirror 20 comprising a curved surface 21 (i.e., light reflection surface) which has a shape of a portion of an elliptic curve having the first focal point F1 and a second focal point F2 on a reference axis of the curved surface, in a cross-sectional surface perpendicular to the axial direction of the light source. In which, the light source 22 is disposed on the first focal point F1. Light radiated from the light source 22 is focused on the second focal point F2. As a result, as shown in FIG. 7, illuminance distribution obtained therewith is such that illuminance is the highest at a portion directly under the reference axis. Even when a curved mirror of a parallel light type is employed, the tendency that the illuminance is high directly under the reference axis and falls steeply in its periphery is the same, and a range where uniform illuminance is obtained is extremely narrow. In the case of using such illuminating device, a molecular weight of a photoreaction product which determines the characteristics of the product is depend not on the light quantity but on the illuminance of light. Accordingly, the degree to which uniform illuminance can be maintained on an irradiation surface is a significant factor that determines the quality of the product. For this reason, also in a case where the illumination devices are arranged either perpendicular or parallel with respect to the feed direction of a subject as disclosed in Reference 1 and Reference 2, the illumination devices must be arranged with gaps as small as possible therebetween for forming uniform illuminance distribution on the surface of the subject. Consequently, a considerable number of illumination devices are used, whereby power consumption is increased, along with a quantity of heat from the illumination devices. In addition, many of the cylindrical light sources are of comparatively high-energy type, whose illuminance is higher than that required for photo-polymerization. Therefore, since light must be attenuated by use of a filter or the like, rendering the cylindrical light source extremely energy-inefficient.

The present invention has been conceived in view of the above circumstances, and aims at providing an illumination device which is capable of effectively irradiating a subject with light from a light source and irradiating a wide range with light of uniform illuminance distribution, and light irradiation apparatus using the same.

DISCLOSURE OF THE INVENTION

The present inventors have made eager investigation to examine the problem. As a result, it has been found that the foregoing objects can be achieved by the following illumination device, light irradiation apparatus and method for providing a photoreaction product sheet. With this finding, the present invention is accomplished.

To solve the above problem, an illumination device according to the present invention is an illumination device comprising a cylindrical light source and a curved mirror for reflecting light radiated from the cylindrical light source, wherein the curved mirror has a light reflection surface which has a shape of a portion of an elliptic curve having a first focal point and a second focal point on a reference axis of the curved surface, in a cross-sectional surface perpendicular to the axial direction of the light source, and the cylindrical light source is disposed on the reference axis at a position between the first focal point and the second focal point.

According to the above configuration, a region where illuminance distribution is uniform can be formed over a wide range from light which has been radiated directly from the cylindrical light source and light which has been reflected by the curved mirror. In particular, a region where the illuminance distribution is uniform can be obtained in a direction perpendicular to the reference axis. In the present invention, the reference axis means a major axis of an elliptic curve which constitutes a curved surface of the curved mirror.

In addition, the illumination device according to the present invention preferably has the distance L1 between the first focal point and a bottom point of the curved mirror is 1 to 40 mm; the distance L2 between the first focal point and the second focal point is 50 to 200 mm; the distance L3 between a light source center of the cylindrical light source and the bottom point of the curved mirror is 20 to 130 mm, provided that L3 is larger than L1, and the sum of L1 and L2 is larger than L3.

According to the above configuration, the illuminance distribution has a trapezoid shape having no peak at a portion directly under the reference axis. Accordingly, a region where the illuminance distribution is uniform can be obtained over a wide range.

In addition, the illumination device according to the present invention is an illumination device comprising a cylindrical light source and a curved mirror for reflecting light radiated from the cylindrical light source, wherein the curved mirror has a light reflection surface which has a shape of a portion of a parabola having a focal point on a reference axis of the curved surface, and the cylindrical light source is disposed on the reference axis at a position between a bottom point of the curved mirror and the focal point.

According to the above configuration, a region where illuminance distribution is uniform can be formed over a wide range with light radiated directly from the cylindrical light source and light reflected by the curved mirror.

In addition, the illumination device according to the present invention preferably has the distance L4 between the focal point and the bottom point of the curved mirror is 40 to 200 mm; the distance L5 between a light source center of the cylindrical light source and the bottom point of the curved mirror is 5 to 50 mm, provided that L4 is larger than L5.

According to the above configuration, a region where illuminance distribution is uniform can be formed over a wide range with light radiated directly from the cylindrical light source and light reflected by the curved mirror.

In addition, the illumination device according to the present invention preferably has the length of the irradiated region where the variation in illuminance falls within ±1 $mW/cm^2$ is not less than 1,000 mm.

In the present invention, the irradiated region where the variation in illuminance falls within ±1 $mW/cm^2$ means a region where an absolute value of a difference between an average value of the illuminance in the irradiated region and a measured value at a point of measurement is not more than 1 $mW/cm^2$.

Light irradiation apparatus according to the present invention employs one of the illumination device mentioned above.

By means of employing the illumination device, uniform illuminance distribution can be obtained over a wide range. Accordingly, a photoreactive composition having a uniform property can be formed. Furthermore, since uniform illuminance distribution can be obtained over a wide range, illumination devices can be arranged with gaps therebetween, thereby enabling a reduction in the number of light sources when compared to that of conventional light irradiation apparatus. Therefore, not only manufacturing cost of the equipment per se, but also running cost of the equipment can be lowered. Consequently, manufacturing cost of a photoreaction product sheet, such as an adhesive tape, which is an end product, can also be lowered.

BEST MODE FOR CARRYING OUT THE INVENTION

Hereinafter, an embodiment of an illumination device according to the present invention will be described by reference to the drawings. Incidentally, the illumination device according to the present invention is not limited the embodiments below, and can be modified within the scope of the present invention.

Figure 1:
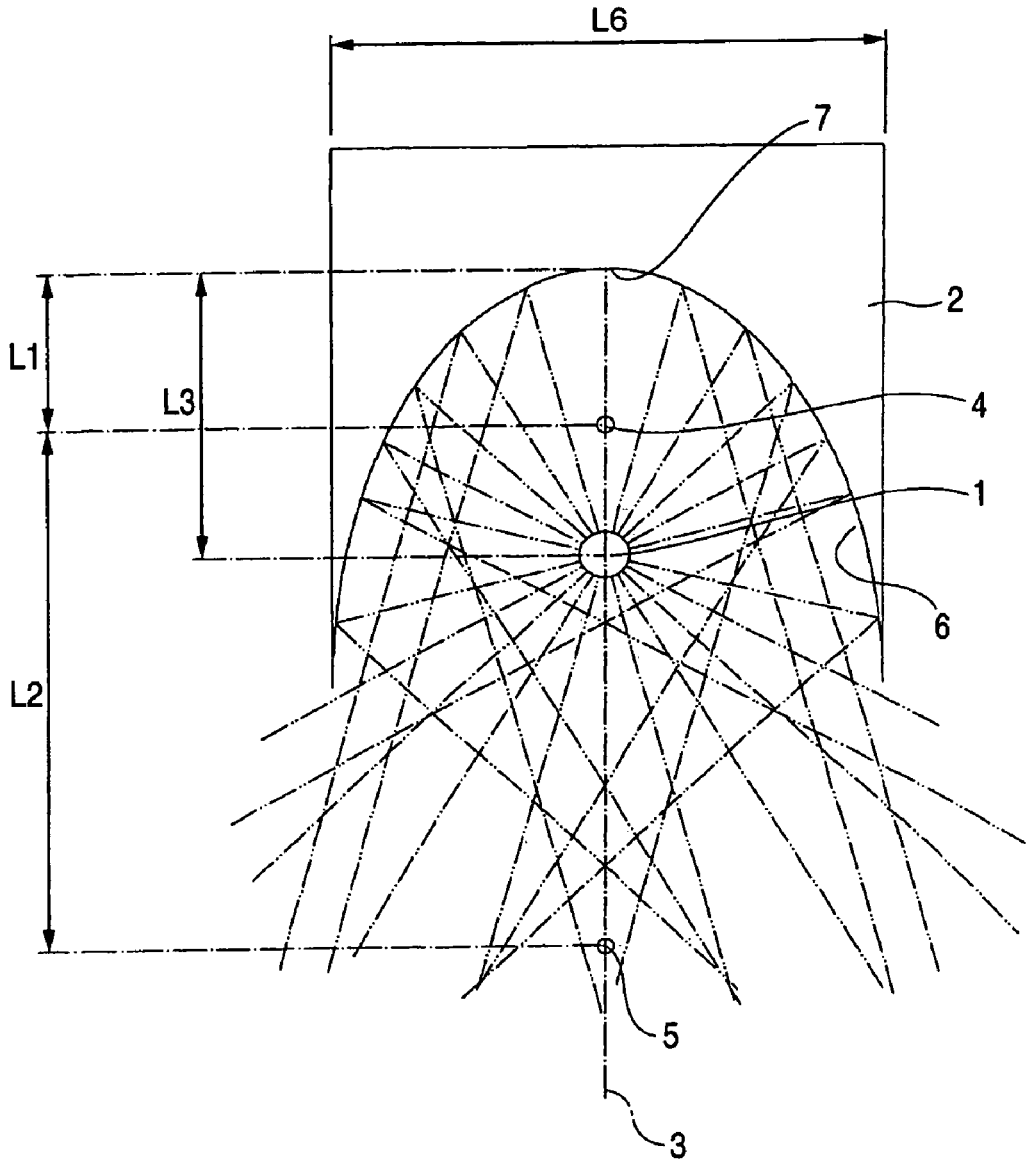
FIG. 1 is a schematic side cross-sectional view of an embodiment of an illumination device according to the present invention.

FIG. 1 is a schematic cross-sectional view of the illumination device according to the embodiment. As shown in FIG. 1, the illumination device according to the embodiment comprises a cylindrical light source 1, and a curved mirror 2 for reflecting light radiated from the cylindrical light source 1.

A light reflection surface (i.e., curved surface 6) of the curved mirror 2 has a shape, in a cross-sectional surface perpendicular to the axial direction of the light source, of a portion of an elliptic curve having the first focal point F1 and a second focal point F2 on a reference axis 3, which is the major axis of the ellipse. The curved mirror 2, whose curved surface 6 has been processed into a mirror surface, is rendered to reflect light from the cylindrical light source 1. In relation to that, light reflectance of the curved mirror 2 is preferably 80% or more in a wavelength range of 300 to 400 nm. By virtue of this, light from the cylindrical light source 1 can be reflected effectively. The curved mirror 2 is preferably formed into a so-called cold mirror, which reflects ultraviolet light from the cylindrical light source 1, and transmits or absorbs infrared light from the same. By virtue of this, the subject of irradiation can be prevented from being affected by heat from the cylindrical light source.

The cylindrical light source 1 is disposed on the reference axis 3 of the curved mirror 2 at a position between the first focal point 4 and the second focal point 5. In the present invention, the distance L1 between the first focal point 4 and a bottom point 7 of the curved mirror 2 is preferably from 1 to 40 mm, more preferably from 10 to 30 mm; a focal-interval distance L2, namely, a distance between the first focal point 4 and the second focal point 5, is preferably from 50 to 200 mm, more preferably from 70 to 170 mm; a distance L3 between the light source center of the cylindrical light source 1 and the bottom point 7 of the curved mirror 2 is preferably from 20 to 130 mm, more preferably from 40 to 100 mm; and L3 is larger than L1, and the sum of L1 and L2 is larger than L3. By virtue of this, light radiated from the cylindrical light source 1 is rendered to be radiated without being focused on the second focal point 5 even when the light is reflected by the curved mirror 2.

The width L6 of the curved mirror is preferably 80 to 260 mm, more preferably 100 to 200 mm.

Figure 2:
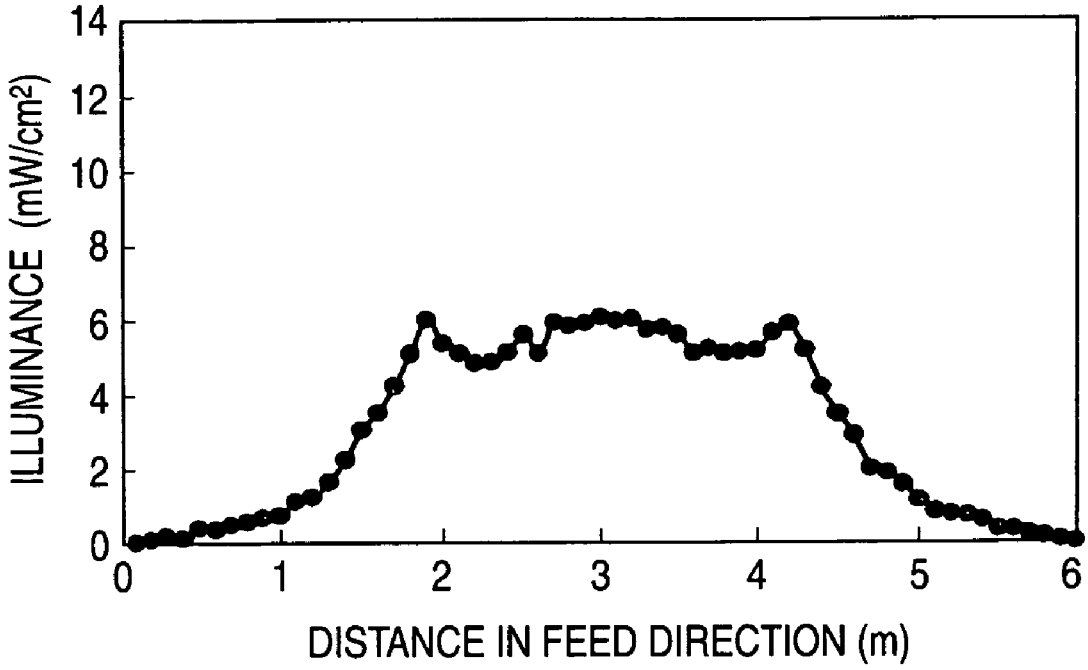
FIG. 2 is a view showing illuminance distribution of the illumination device shown in FIG. 1.
Figure 7:
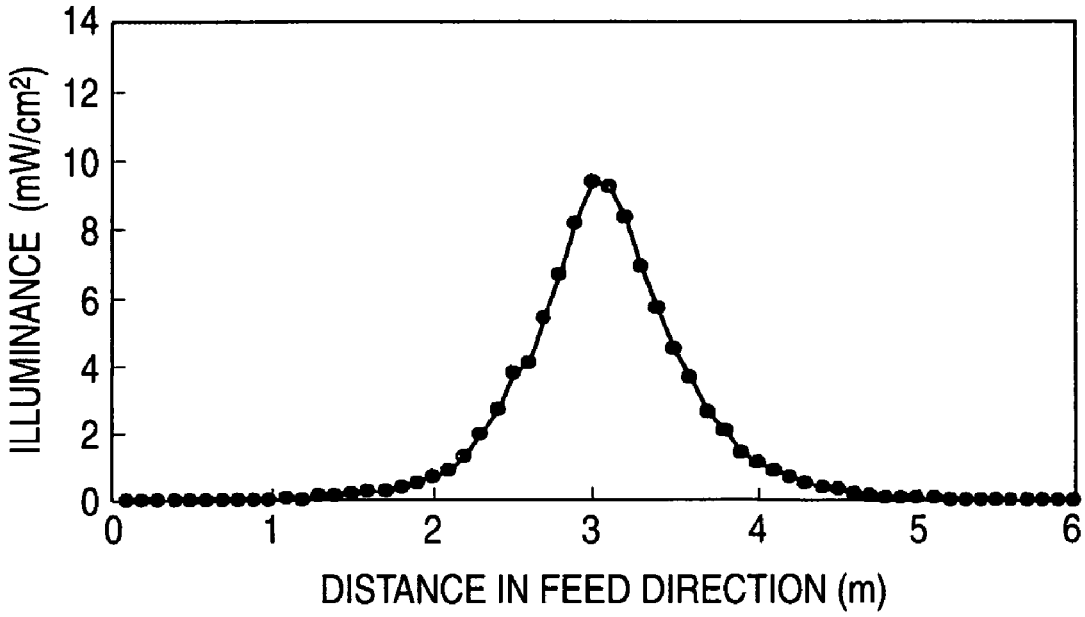
FIG. 7 is a view showing illuminance distribution of the illumination device shown in FIG. 6.

As a result, illuminance distribution of a substantially trapezoid shape including a region where the illuminance distribution is uniform is obtained as shown in FIG. 2, in contrast to the illuminance distribution, obtained with a conventional illumination device, of an angular shape having a peak at a portion directly under the reference axis (see FIG. 7). In other words, by means of disposing the cylindrical light source 1 within the above-mentioned ranges, a region where the illuminance distribution is uniform can be obtained over a wide range.

The cylindrical light source 1 preferably radiates light including that of the ultraviolet range. Examples thereof includes any one or a combination of a low-pressure mercury lamp, a medium-pressure mercury lamp, a high-pressure mercury lamp, an ultra-high pressure mercury lamp, a chemical lamp, a black light lamp, a microwave-excited mercury lamp, a metal halide lamp, an excimer laser, and the like. The illuminance of the cylindrical light source 1 is preferably from 0.1 to 300 mW/cm$^2$, more preferably 1 to 50 mW/cm$^2$. Usage of an illumination device of such illuminance enables sufficient promotion of photo-polymerization of the subject, such as a photoreaction product sheet.

The distance between the light source and the subject is preferably 30 to 180 cm, more preferably 50 to 150 cm.

Figure 3:
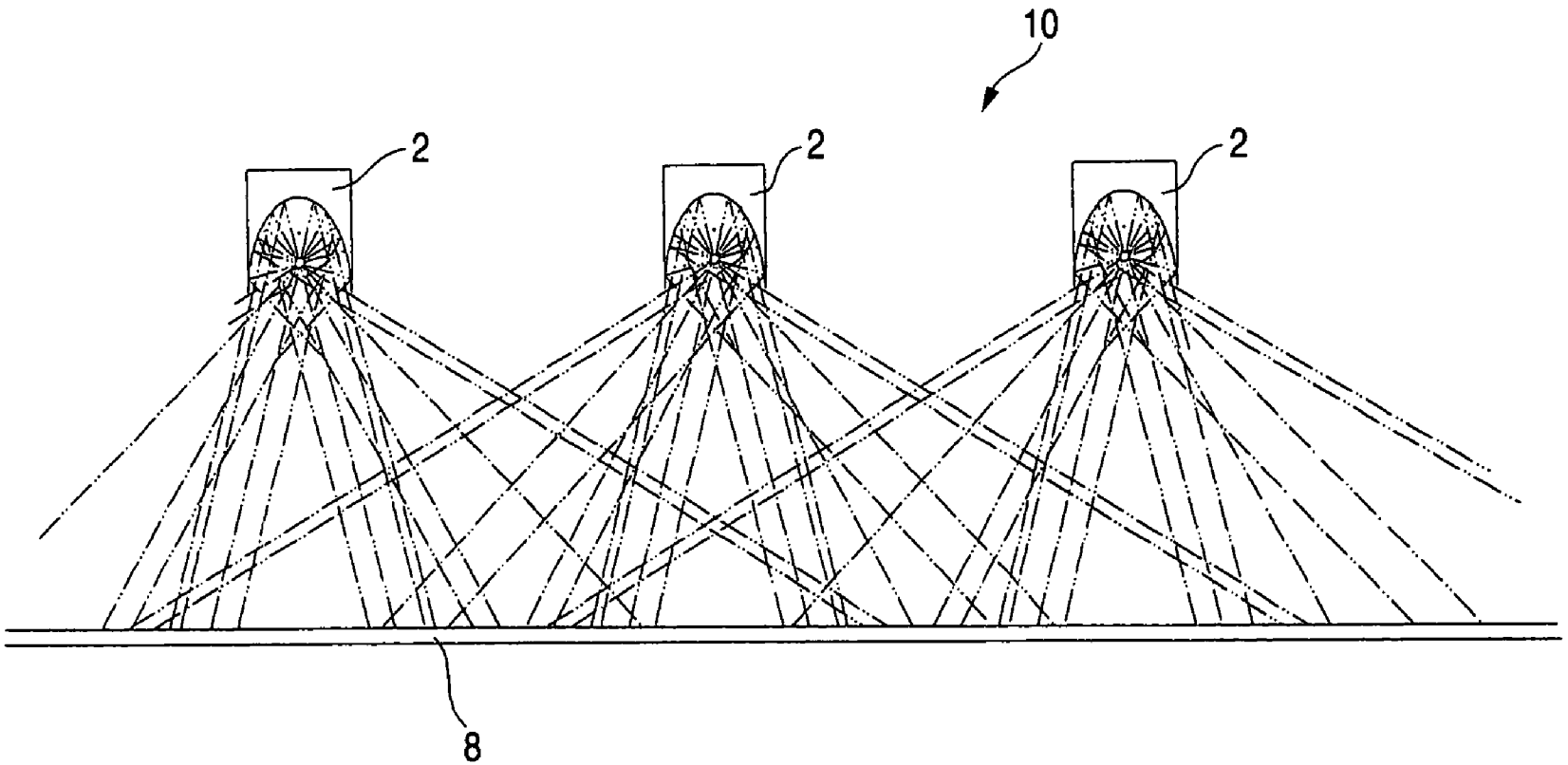
FIG. 3 is a schematic view showing an essential portion of light irradiation apparatus using the illumination device shown in FIG. 1.

Next, light irradiation apparatus using the illumination device according to the embodiment will be described. FIG. 3 is a schematic view showing an essential portion of the light irradiation apparatus according to the embodiment. Referring to FIG. 3, the light irradiation apparatus 10 comprises major components of an unillustrated illumination chamber and the illumination devices. Treatment for enhancing reflection and diffusion is applied on an inner wall of the illumination chamber. The illumination devices are set in the illumination chamber at predetermined intervals in such a manner as to irradiate a subject 8 with light.

Figure 4:
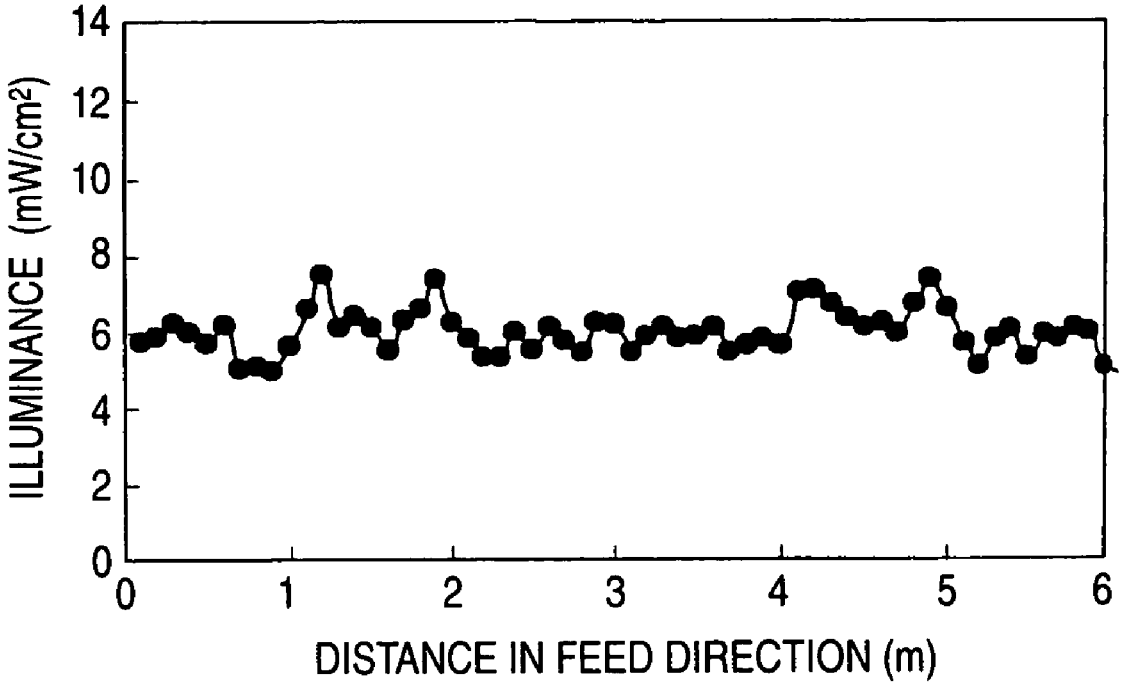
FIG. 4 is a view showing illuminance distribution on the surface of a subject radiated by the illumination device shown in FIG. 3.

FIG. 4 shows illuminance distribution with respect to a feed direction of the subject 8 in a case where a distance between the illumination devices is set to 3 m, and a distance between the light source and the subject 8 is set to 1.5 m. As shown in FIG. 4, the light irradiation apparatus 10 according to the embodiment employs the illumination devices which provide a wide range where illuminance distribution is uniform. Accordingly, illuminance distribution can be rendered substantially uniform with respect to the feed direction of the subject 8. Thus, since uniform light can be radiated on the subject 8 over a wide range, a photoreaction product sheet of uniform property can be obtained.

The subject 8 comprises, for example, a sheet-shaped material and a photoreactive composition applied on the surface thereof. Example of such a sheet-shaped material include a plastic film such as a polyester film, non-woven fabric, woven fabric, paper, or metal foil.

The photoreactive composition includes those from which monomers are formed upon light irradiation, as well as photo-polymerizable compositions containing monomers or partially-polymerized monomers, and a polymerization initiator. In relation to the above, it is preferable to use the photo-polymerizable composition which is such a material that is polymerized upon light irradiation, thereby being formed into a pressure-sensitive adhesive; and includes acrylic, polyester, and epoxy photo-polymerizable compositions. Among them, the acrylic photo-polymerizable composition is particularly preferably used.

As the photo-polymerizable composition, monomers consisting of an alkyl acrylate monomer as the main component, and a copolymerizable monomer containing a polar group are preferably used. Examples of the alkyl acrylate monomer for use in the present invention include a vinyl monomer whose main component is a (meth)acrylic acid ester. More specifically, one or more monomers selected from those whose alkyl group has 1 to 14 carbon atoms can be used as the main component, e.g., alkyl acrylate, alkyl metacrylate, in which the alkyl group may be partially substituted with hydroxy group; each of these contains an alkyl group, such as a methyl group, an ethyl group, a propyl group, a butyl group, an isobutyl group, a pentyl group, an isopentyl group, a hexyl group, a heptyl group, an octyl group, an isooctyl group, a nonyl group, an isononyl group, a decyl group, or an isodecyl group.

Examples of the copolymerizable monomer containing a polar group include an unsaturated acid, such as itaconic acid, or 2-acrylamide propanesulphonic acid; a monomer containing a hydroxyl group, such as 2-hydroxyetyl(meth)acrylate, or 2-hydroxypropyl(meth)acrylate; and caprolactone(meth) acrylate. In addition, the copolymerizable monomer is not necessarily a monomer, and may be a dimer, such as a (meth) acrylic acid dimer.

Monomers comprising an alkyl acrylate monomer as the main component and a copolymerizable monomer containing polar groups are preferably used in a ratio of: 70 to 99 parts by weight to 30 to 1 parts by weight, more preferably 80 to 96 parts by weight to 20 to 4 parts by weight. When the monomers are used in a ratio within the above ranges, a favorable balance in terms of adhesiveness, cohesive strength, and the like can be attained.

Examples of a photo-polymerization initiator include a benzoin ether, such as benzoin methyl ether or benzoin isopropyl ether; a substituted benzoin ether, such as anisole methyl ether; a substituted acetophenone, such as dietoxyacetophenone, 2,2-diethoxyacetophenone, or 2,2-dimethoxy-2-phenyl acetophenone; a substituted-α-ketol, such as 2-methyl-2-hydroxy propiophenone; an aromatic sulfonyl chloride, such as 2-naphtalene sulfonyl chloride; and a photoactive oxime, such as 1-phenyl-1,1-propanedione-2-(o-ethoxycarbonyl)-oxime. The usage amount of such a photo-polymerization initiator is preferably 0.1 to 5 parts by weight, and more preferably 0.1 to 3 parts by weight, with respect to 100 parts by weight of total of the monomers comprising alkyl acrylate monomers serving as the main component and the copolymerizable monomers containing a polar group. When the amount of the photo-polymerization initiator falls below the above range, the polymerization velocity is decreased, whereby monomers tend to remain in large quantity, which is unfavorable from an industrial viewpoint. In contrast, when the amount of the same exceeds the range, molecular weight of the polymer is reduced, which leads to a decrease in cohesive strength of the adhesive. As a result, preferable adhesive property cannot be obtained.

In addition, as a crosslinking agent, a polyfunctional acrylate monomer is preferably used. Examples thereof include an alkyl aclylate monomer containing two or more functional groups, such as trimethylolpropane triacrylate, pentaerythritol tetraacrylate, 1,2-ethyleneglycol diacrylate, 1,6-hexanediol diacrylate, and 1,12-dodecanediol diacrylate. A usage amount of the multifunctional acylate monomer depends on the number of the functional groups, and is preferably 0.01 to 5 parts by weight, and more preferably 0.1 to 3 parts by weight, with respect to 100 parts total of the monomer comprising the alkyl acrylate monomer serving as the main component and the copolymerizable monomer containing a polar group. When the multifunctional acylate monomer is used in a ratio within the above range, favorable cohesive strength is maintained.

In addition, another crosslinking agent other than the multifunctional acrylate may be used in combination, depending on the purposes of the adhesive. Examples of the crosslinking agent to be used in combination include those which are generally used, such as an isocyanate crosslinking agent, an epoxy crosslinking agent, and an aziridine crosslinking agent. In the present invention, additives such as a tackifier may be used as necessary.

Figure 5:
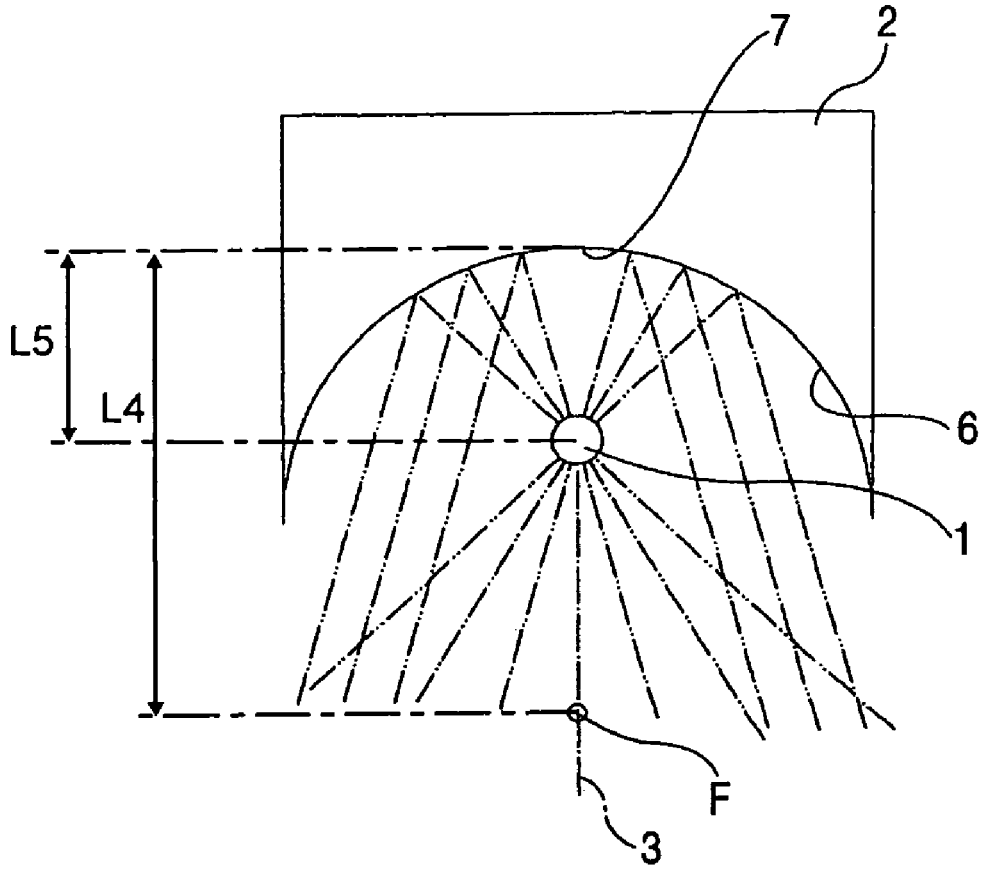
FIG. 5 is a side cross-sectional view of another embodiment of the illumination device according to the present invention.
Figure 6:
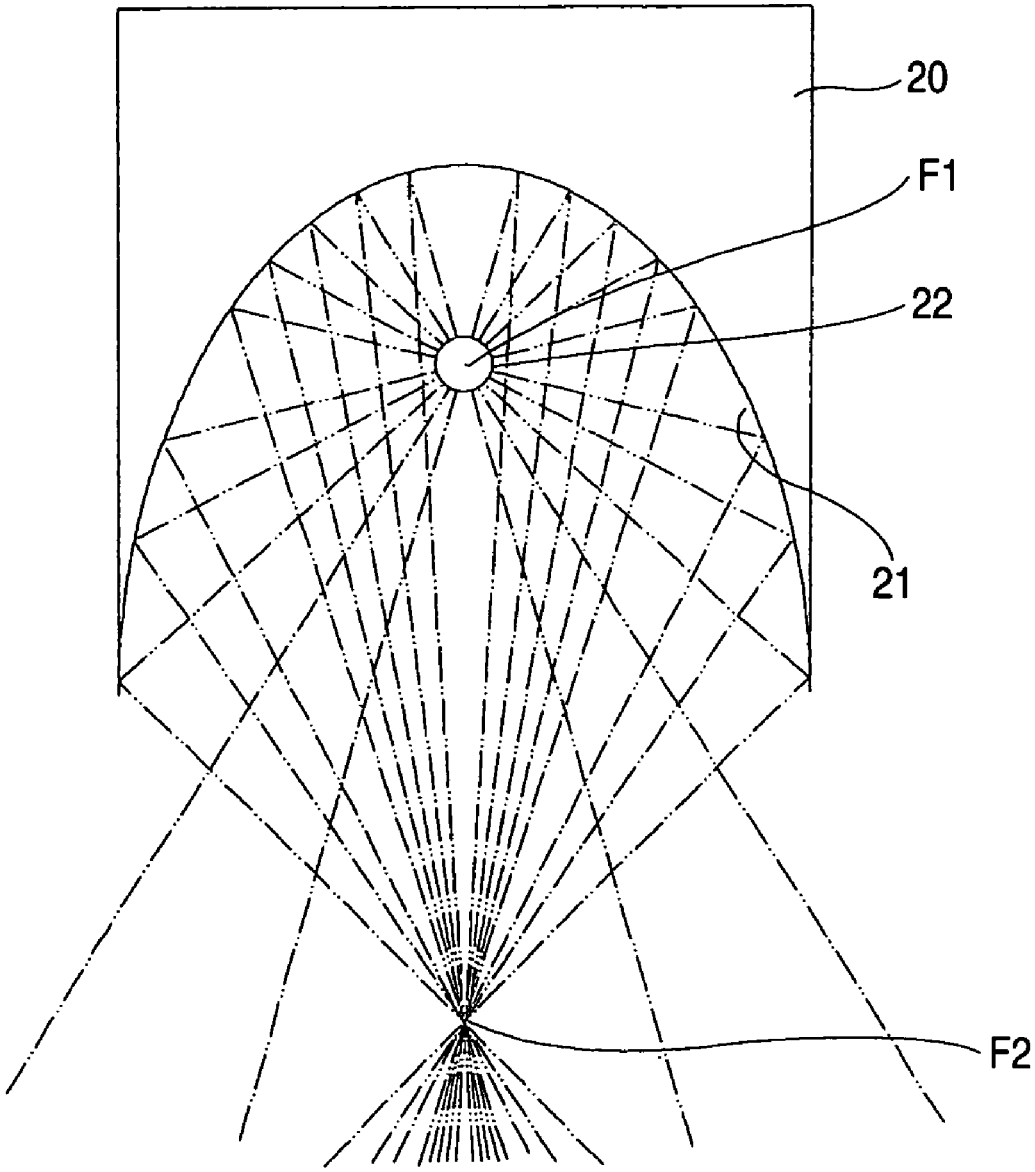
FIG. 6 is a schematic side cross-sectional view of a conventional illumination device.

In addition, other than the above-described curved mirror 2, whose curved surface 6 (light reflection surface) has a shape of a portion of an elliptic curve in a cross-sectional surface perpendicular to the axial direction of the light source, the illumination device according to the present invention can be formed, for instance, to have a curved mirror 2 whose light reflection surface has a shape of a portion of a parabola in a cross-sectional surface perpendicular to the axial direction of the light source, as shown in FIG. 5.

In this case, the cylindrical light source 1 is disposed at a position between the bottom point 7 of the curved mirror 2 and a focal point F. In the present invention, the distance L4 between the focal point F and the bottom point 7 of the curved mirror 2 is preferably 40 to 200 mm, more preferably 70 to 150 mm; the distance L5 between the light source center of the cylindrical light source 1 and the bottom point 7 of the curved mirror 2 is preferably 5 to 50 mm, more preferably 5 to 40 mm; and L4 is larger than L5. By means of configuring the curved mirror 2 and disposing the cylindrical light source 1 within the above range, light radiated from the cylindrical light source 1 is caused to be radiated without being focused on the focal point F after being reflected on the curved mirror 2. As a result, a region where illuminance distribution is substantially uniform having no peak at a portion directly under the reference axis can be obtained.

Incidentally, when an irradiation chamber that does not has an enough size in height is used, it is preferable that the irradiation chamber preferably has: a illumination device disposed so as to irradiate a light from downside to upside of a subject to be radiated; and a reflection plate disposed on a upside inner wall of the chamber, in stead of disposing a illumination device so as to irradiate a light from upside to downside. Thereby, even in the case of an irradiation chamber does not has an enough size in height, a light irradiated from the cylindrical light source can be reflected by the upper inner wall or the reflection plate and irradiated onto a subject to be radiated. As a result thereof, a light can be uniformly irradiated over a subject to be radiated.

EXAMPLES

The present invention is now illustrated in greater detail with reference to Examples and Comparative Examples, but it should be understood that the present invention is not to be construed as being limited thereto.

Example 1

As a subject to be radiated, a PET sheet (manufactured by TORAY Industries, Inc., Lumirror S10) was set; and a high-pressure mercury lamp (120 W/cm; emission length 250 mm) was disposed at a location of 1 m from the subject as the cylindrical light source. The light source was set such that the direction of the reference axis is perpendicular to the feed direction of the sheet. An elliptic curved mirror, in which a distance between the first focal point and the bottom point of the curved mirror was 20 mm, a distance between the first and second focal points was 150 mm, and a distance between the light source center and the bottom point of the curved mirror was 60 mm, was set. The curved mirror was 117 mm in width. Measurement of illuminance on the PET sheet, with illuminance meter UVR-T1 (manufactured by TOPCON CORPORATION; light receiver unit UD-T36; measurement wavelength 300 to 390 nm; peak-sensitive wavelength 350 nm), showed that a length of the irradiated region (in a feed direction of sheet) where a variation in illuminance falls within ±1 mW/cm$^2$ was 3,900 mm.

Example 2

A curved mirror of a parabola shape, in which a distance between the bottom point of the curved mirror and the focal point was 100 mm, a distance between the light source center and the bottom point of the curved mirror was 20 mm, and the width of the curved mirror was 200 mm was set. In all other respects, the experimental condition was rendered analogous to that of Example 1. Measurement of illuminance on the PET sheet showed that a length of the irradiated region (in a feed direction of sheet) where the variation in illuminance falls within ±1 mW/cm$^2$ was 2,300 mm.

Comparative Example 1

An elliptic curved mirror was used, and the cylindrical light source was disposed at the focal point on a side closer to the bottom point of the curved mirror; that is, at the first focal point. In all other respects, the experimental condition was rendered analogous to that of Example 1. Measurement of illuminance on the PET film showed that a length of the irradiated region (in a feed direction of sheet) where the variation in illuminance falls within ±1 mW/cm$^2$ was 900 mm.

Comparative Example 2

A curved mirror of a parabola shape was used, and the cylindrical light source was disposed at a focal point of the curved mirror. In all other respects, the experimental condition was rendered analogous to that of Example 2. Measurement of illuminance on the PET film showed that a length of the irradiated region (in a feed direction of sheet) where the variation in illuminance falls within ±1 mW/cm$^2$ was 400 mm.

As described above, the illumination device according to the present invention is capable of providing a region where illuminance distribution is uniform over a wide range. Therefore, even when the illumination device is used, for example, as a light source of light irradiation apparatus for forming a photoreaction product sheet, the illumination devices are not necessarily disposed with no gaps therebetween for achieving uniform illuminance distribution, as is the case in a conventional technique. Accordingly, the number of illumination devices to be disposed can be reduced. By virtue of the above, the light irradiation apparatus can be miniaturized, thereby enabling significant lowering of manufacturing cost.

According to the present invention, a region where the illuminance distribution is uniform can be obtained over a wide range. As a result, for instance, when employed as a light source of light irradiation apparatus for producing a photoreaction product sheet, such as an adhesive tape, the illumination devices can be arrayed with desired gaps therebetween. Accordingly, a number of the light sources to be used can be reduced. Consequently, manufacturing cost of the equipment can be lowered, along with manufacturing cost of a photoreaction product sheet, which is an end product.

While the present invention has been described in detail and with reference to specific embodiments thereof, it will be apparent to one skilled in the art that various changes and modifications can be made therein without departing the spirit and scope thereof.

The present application is based on Japanese Patent Application No. 2004-027542 filed on Feb. 4, 2004, and the contents thereof are incorporated herein by reference.

INDUSTRIAL APPLICABILITY

By the present invention, uniform illuminance distribution can be obtained over a wide range. Accordingly, when being used as a light source of an illumination device for forming a photoreaction product sheet such as a pressure-sensitive adhesive tape, the light sources can be arranged with arbitrary gaps therebetween, thereby enabling a reduction in the number of light sources. Therefore, not only manufacturing cost of the equipment per se, but also manufacturing cost of a photoreaction product sheet such as a pressure-sensitive adhesive tape, which is an end product, can also be lowered.

What is claimed is:

1. An illumination device comprising:

a cylindrical light source; and a curved mirror for reflecting light radiated from the cylindrical light source, the curved mirror having a light reflection surface having a shape of a portion of an elliptic curve having a first focal point and a second focal point on a reference axis of the curved surface, in a cross-sectional surface perpendicular to the axial direction of the light source, and the cylindrical light source being disposed on the reference axis at a position between the first focal point and the second focal point, wherein the distance L1 between the first focal point and a bottom point of the curved mirror is 1 to 40 mm; the distance L2 between the first focal point and the second focal point is 50 to 200 mm; the distance L3 between a light source center of the cylindrical light source and the bottom point of the curved mirror is 20 to 130 mm; and L3 is larger than L1, and the sum of L1 and L2 is larger than L3.

2. The illumination device according to claim 1, wherein the length, regarding the cylindrical light source as a center, of the irradiated region where the variation in illuminance on the subject falls within ±1 $mW/cm^2$ is not less than 1,000 mm.

3. An illumination device comprising:

a cylindrical light source; and a curved mirror for reflecting light radiated from the cylindrical light source, the curved mirror having a light reflection surface having a shape of a portion of a parabola having a focal point on a reference axis of the curved surface in a cross-sectional surface perpendicular to the axial direction of the light source, and the cylindrical light source being disposed on the reference axis at a position between a bottom point of the curved mirror and the focal point, wherein the distance L4 between the focal point and the bottom point of the curved mirror is 40 to 200 mm; the distance L5 between a light source center of the cylindrical light source and the bottom point of the curved mirror is 5 to 50 mm; and L4 is larger than L5.

4. The illumination device according to claim 3, wherein the length, regarding the cylindrical light source as a center, of the irradiated region where the variation in illuminance on a subject falls within ±1 $mW/cm^2$ is not less than 1,000 mm.

5. A light irradiation apparatus comprising an illumination device according to claim 1.

6. A light irradiation apparatus comprising an illumination device according to claim 3.

7. A method for producing a photoreaction product sheet comprising irradiating a light to a photoreactive composition with an irradiation apparatus according to claim 5.

8. A method for producing a photoreaction product sheet comprising irradiating a light to a photoreactive composition with an irradiation apparatus according to claim 6.

* * * * *